US007437105B2

(12) United States Patent
Koyama

(10) Patent No.: US 7,437,105 B2
(45) Date of Patent: Oct. 14, 2008

(54) DEVELOPING DEVICE AND IMAGE FORMING APPARATUS

(75) Inventor: Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 21 days.

(21) Appl. No.: 11/461,003

(22) Filed: Jul. 31, 2006

(65) Prior Publication Data

US 2007/0031168 A1 Feb. 8, 2007

(30) Foreign Application Priority Data

Aug. 2, 2005 (JP) ..... 2005-224561

(51) Int. Cl.
*G03G 15/08* (2006.01)

(52) U.S. Cl. ..... 399/254; 222/DIG. 1; 366/323; 399/256

(58) Field of Classification Search ..... 399/254, 399/256, 258; 366/279, 292, 297, 318, 323, 366/342, 343; 222/DIG. 1
See application file for complete search history.

(56) References Cited

U.S. PATENT DOCUMENTS 5,264,900 A * 11/1993 Momiyama et al. ..... 399/256
5,495,320 A * 2/1996 Araki et al. ..... 399/256
5,657,115 A * 8/1997 Sugihara ..... 366/323 X
5,722,002 A * 2/1998 Kikuta et al. ..... 399/256 X
6,047,152 A * 4/2000 Hattori et al. ..... 399/256
6,360,066 B1 * 3/2002 Kawahito et al. ..... 399/254
2006/0024090 A1 2/2006 Koido
2006/0045573 A1 * 3/2006 Yamaguchi et al. ..... 399/254

FOREIGN PATENT DOCUMENTS

JP 09-146352 A 6/1997
JP 11-024403 A * 1/1999
JP 2001-042617 A * 2/2001
JP 2004-302014 A * 10/2004

* cited by examiner

*Primary Examiner*—Sophia S Chen
(74) *Attorney, Agent, or Firm*—Panitch Schwarze Belisario & Nadel LLP

(57) ABSTRACT

A developing device includes a developer bearing body that partially faces the inside of a developer storing chamber, a first developer carrying member disposed in the chamber together with the body, and a second developer carrying member disposed in the chamber together with the first carrying member. The body is rotatable and bears a developer. The first carrying roller rotates to carry the developer in an axial direction, and the second carrying member rotates to carry the developer in an axial direction. The first carrying member carries the developer from end portions of the chamber toward a center portion of the chamber, and the second carrying member carries the developer from the center portion toward the end portions. An amount of the developer carried by the first carrying member is greater than an amount of the developer carried by the second carrying member.

10 Claims, 8 Drawing Sheets

DEVELOPING DEVICE AND IMAGE FORMING APPARATUS

BACKGROUND OF THE INVENTION

This invention relates to a developing device and an image forming apparatus.

In a conventional electrophotographic image forming apparatus (for example, a printer, a copier, a facsimile machine, a complex machine or the like), a surface of a photosensitive drum is uniformly charged, and the surface of the photosensitive drum is exposed with light to form a latent image thereon. The latent image is developed with toner adhering to the latent image by electrostatic attraction, so that a toner image is formed on the photosensitive drum. The toner image is transferred to a recording sheet, and then fixed to the recording sheet, with the result that the toner image is formed on the recording sheet.

An arrangement for forming the toner image on the photosensitive drum is integrated into a developing device. The developing device is detachably attached to a main body of the image forming apparatus such as a printer. The developing device includes a toner cartridge that stores the toner. The toner cartridge is detachably attached to a main body of the developing device.

FIG. 12 is a plan view of a main part of a conventional developing device.

In FIG. 12, a developer storing chamber 24 is formed in a main body of a developing device, and stores the toner. First and second developer carrying members 28 and 29 are disposed in the developer storing chamber 24. The second developer carrying member 29 faces a developing roller 31. A partition plate 32 is disposed between the first and second developer carrying members 28 and 29, and extend in the direction parallel to the axes of the first and second developer carrying members 28 and 29. The developer storing chamber 24 is divided by the partition plate 32 into first and second chambers C1 and C2. The first and second chambers C1 and C2 are connected to each other at end portions 24*a* and 24*b* respectively formed adjacent to both ends of the partition plate 32.

The toner is supplied to the developer storing chamber 24 through a supply port 25 formed at the end portion 24*a* of the developer storing chamber 24. Then, the first developer carrying member 28 carries the toner in the direction shown by an arrow "a" from the end portion 24*a* to the other end portion 24*b* of the developer storing chamber 24. The second developer carrying member 29 carries the toner in the direction shown by an arrow "b", from the end portion 24*b* to the end portion 24*a* of the developer storing chamber 24. Further, the first developer carrying member 28 again carries the toner in the direction shown by the arrow "a" from the end portion 24*a* to the end portion 24*b*.

With such an arrangement, the toner is carried by the developer carrying members 28 and 29 in both directions "a" and "b" and circulate in the developer storing chamber 24, so that the evenness of the distribution of the toner can be improved.

If the toner stays at one of the end portions 24*a* and 24*b*, the distribution of the toner becomes uneven. Therefore, the amount of the toner carried by the developer carrying members 28 and 29 are set to be different from each other, as disclosed in Japanese Laid-Open Patent Publication No. 9-146352.

However, in the conventional developing device, even if the amount of the toner carried by the developer carrying members 28 and 29 are different from each other, it is difficult to sufficiently improve evenness of the distribution of the toner, and therefore it is difficult to prevent the agglomeration of the toner at the end portion 24*a* or the end portion 24*b*.

If the toner is agglomerated at the end portion 24*a* or the end portion 24*b* of the developer storing chamber 24, a stain, fog or the like may be generated at an end portion of the recording sheet. Moreover, the density of the toner at the center of the developer storing chamber 24 may decrease, and therefore an image blurring may be caused at the center portion of the recording sheet. Furthermore, there is a difference between charges of the toner (adhering to the developing roller 31) at the end portions and at the center portion, and therefore the unevenness of the image density may occur.

As a result, the quality of the image may be degraded.

SUMMARY OF THE INVENTION

An object of the present invention is to provide a developing device and an image forming apparatus capable of enhancing the quality of the image.

The present invention provides a developing device including a developer bearing body that partially faces the inside of a developer storing chamber, a first developer carrying member disposed in the developer storing chamber together with the developer bearing body, and a second developer carrying member disposed in the developer storing chamber together with the first developer carrying member. The developer bearing body is rotatable and bears a developer. The first developer carrying member rotates to carry the developer in an axial direction. The second developer carrying member rotates to carry the developer in an axial direction. The first developer carrying member carries the developer from end portions of the developer storing chamber toward a center portion of the developer storing chamber, and the second developer carrying member carries the developer from the center portion toward the end portions. An amount of the developer carried by the first developer carrying member is greater than an amount of the developer carried by the second developer carrying member.

With such an arrangement, the amount of the developer at the center portion of the developer storing chamber increases, and the amount of the developer at the end portions of the developer storing chamber decreases. Accordingly, it becomes possible to prevent the agglomeration of the developer at the end portions of the developer storing chamber. Therefore, it becomes possible to prevent the stain or fog at the end portion of the recording medium. Further, since the density of the developer does not decrease at the center portion of the recording medium, it becomes possible to prevent the image blurring at the center portion of the recording medium. Moreover, a difference between charges of the developer adhering to the developer bearing body at the end portions and at the center portion can be restricted, and therefore the unevenness of the image density can be prevented.

As a result, it becomes possible to enhance the quality of the image.

DETAILED DESCRIPTION OF THE PREFERRED EMBODIMENT

Embodiments of the present invention will be described with reference to the attached drawings. Hereinafter, a color printer will be described as an example of an image forming apparatus.

First Embodiment

Figure 1:
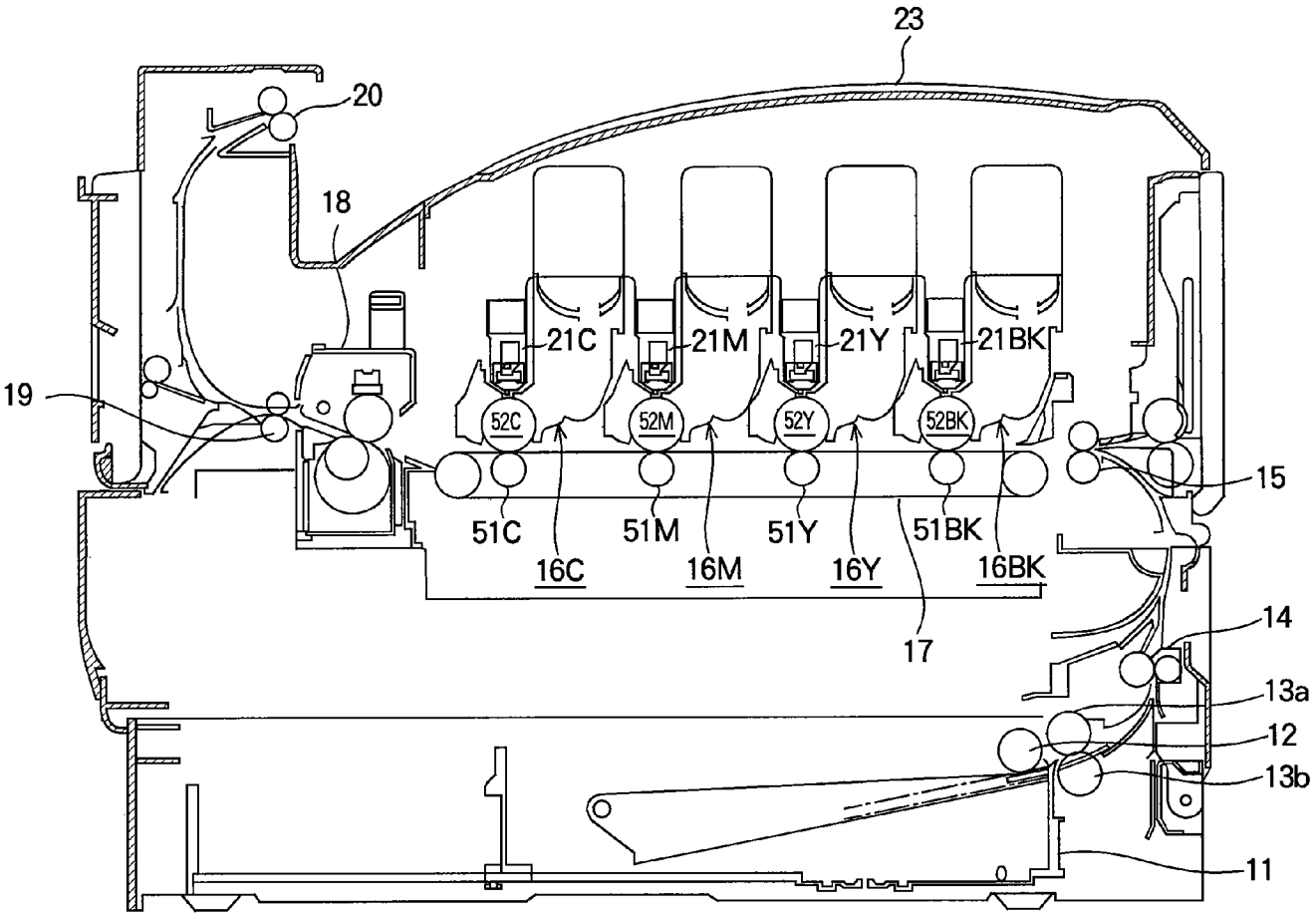
FIG. 1 is a schematic view of a printer according to a first embodiment of the present invention.

FIG. 1 is a schematic view of a printer according to the first embodiment of the present invention.

In FIG. 1, a sheet cassette 11 is disposed at a lower part of a main body of the printer. The sheet cassette 11 stores recording sheets as recording media. A sheet feeding mechanism is disposed on the front side of the sheet cassette 11, and feeds the recording sheet one by one. The sheet feeding mechanism includes a separation roller 12 and feeding rollers 13*a* and 13*b*, and feeds the recording sheet along a sheet feeding path toward carrying roller portions 14 and 15. The carrying roller portions 14 and 15 are disposed along the sheet feeding path at the downstream side of the feeding rollers 13*a* and 13*b*.

A carrying belt 17 (i.e., a carrying member) is disposed adjacent to the carrying roller portion 15. The carrying belt 17 moves and carries the recording sheet through between developing devices 16BK, 16Y, 16M and 16C (i.e., image forming portions that respectively form images of black, yellow, magenta and cyan) and transfer rollers 51BK, 51Y, 51M and 51C (i.e., transfer devices). The carrying belt 17 and the transfer rollers 51BK, 51Y, 51M and 51C constitute a transfer unit.

The developing devices 16BK, 16Y, 16M and 16C respectively include photosensitive drums 52BK, 52Y, 52M and 52C. The transfer rollers 51BK, 51Y, 51M, and 51C respectively transfer toner images of the respective colors formed on the photosensitive drums 52BK, 52Y, 52M and 52C to the recording sheet in series, so as to form a color toner image.

A fixing device 18 fixes the color toner image to the recording sheet when the recording sheet (on which the color toner image is transferred) reaches the fixing device 18. The recording sheet ejected by the fixing device 18 is carried by carrying rollers 19, and is ejected to the exterior of the printer by eject rollers 20.

LED heads 21BK, 21Y, 21M and 21C (i.e., exposing devices) are disposed respectively in opposition to the photosensitive drums 52BK, 52Y, 52M and 52C, in order to expose the surfaces of the photosensitive drums 52BK, 52Y, 52M and 52C to form latent images thereon.

Further, the developing devices 16BK, 16Y, 16M and 16C are detachably attached to the main body of the printer. For the detachment and the attachment of the developing devices 16BK, 16Y, 16M and 16C, an openable and closable upper cover 23 is disposed on top of the main body of the printer. The LED heads 21BK, 21Y, 21M and 21C are held by the upper cover 23.

Next, the developing devices 16BK, 16Y, 16M and 16C will be described. The developing devices 16BK, 16Y, 16M and 16C have the same structures, and therefore the description is made to the developing device 16BK. The description of the developing devices 16Y, 16M and 16C is omitted.

Figure 2:
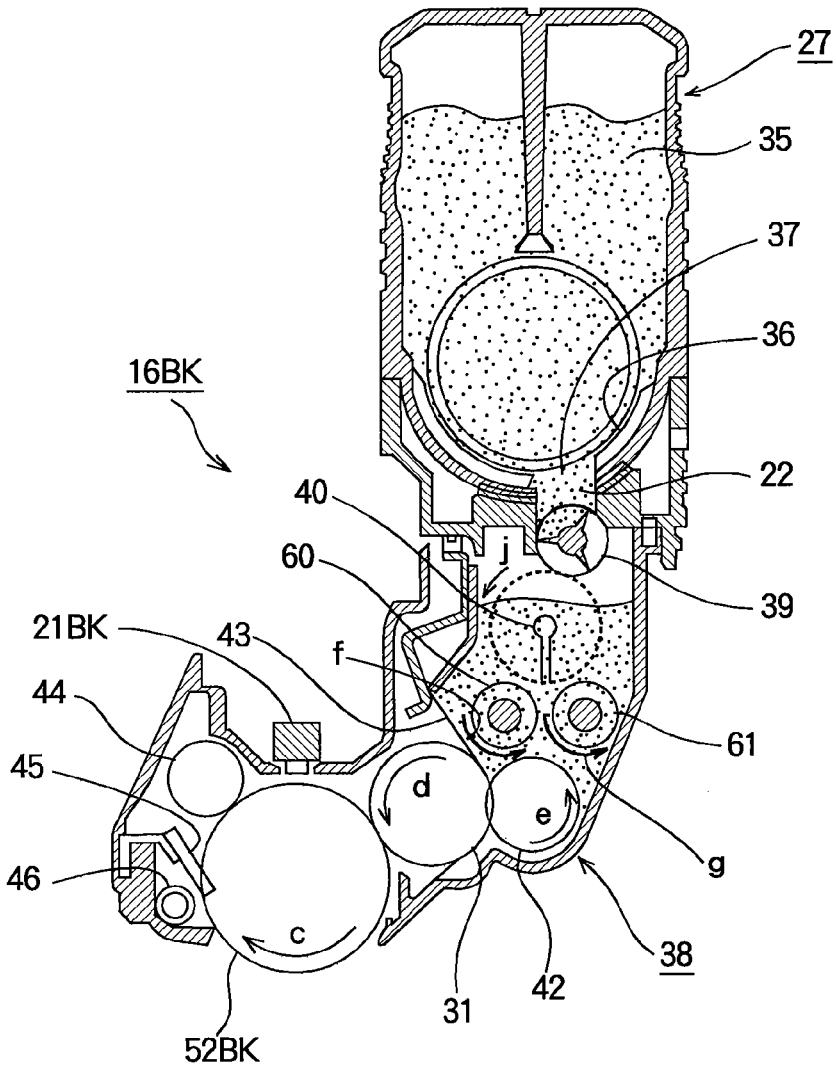
FIG. 2 is a sectional view of a developing device according to the first embodiment of the present invention.
Figure 3:
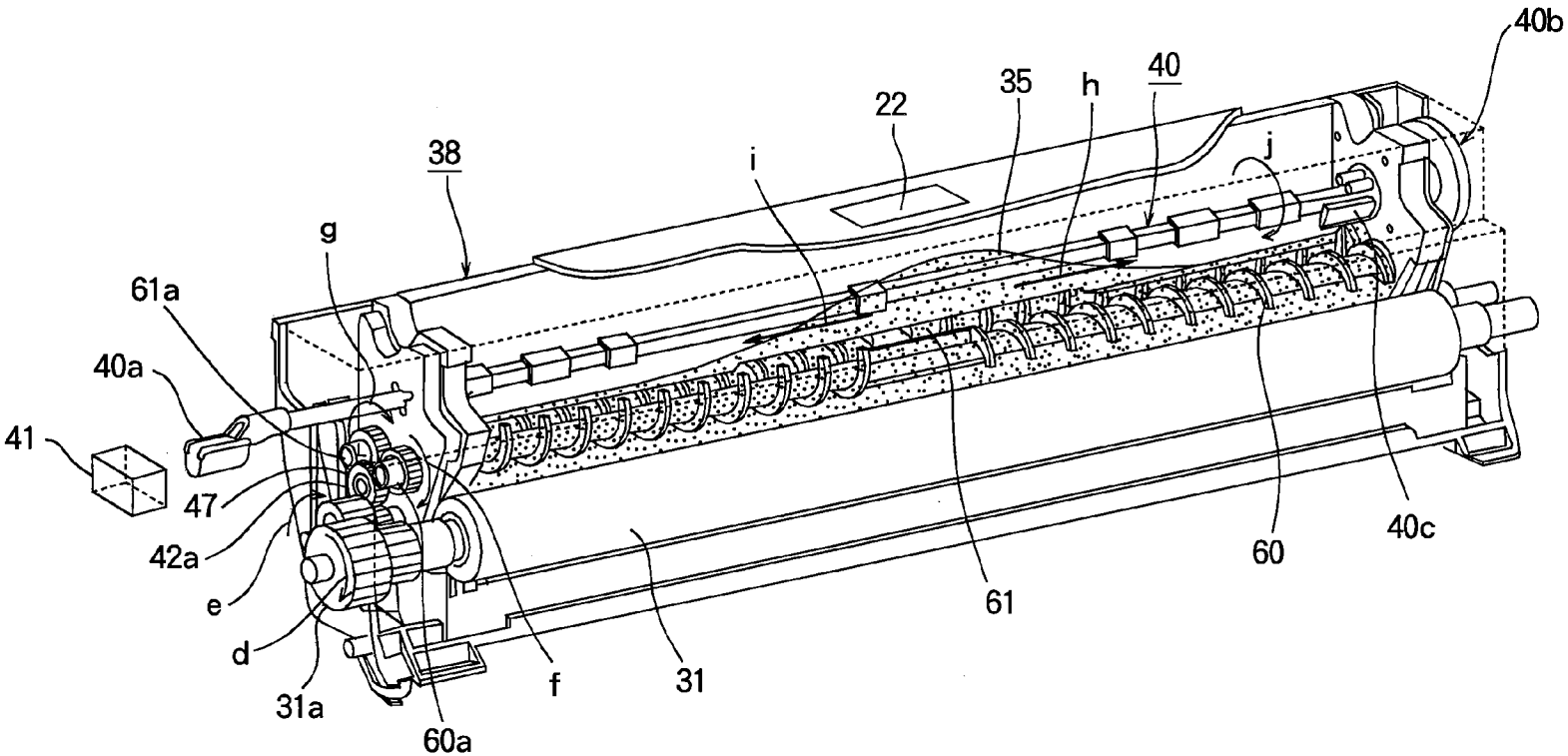
FIG. 3 is a perspective view of the developing device according to the first embodiment of the present invention.
Figure 4:
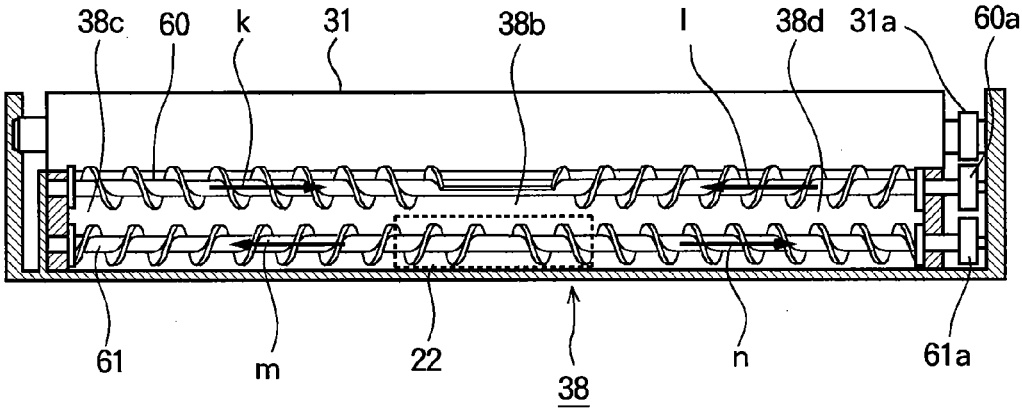
FIG. 4 is a plan view of a main part of the developing device according to the first embodiment of the present invention.
Figure 5:
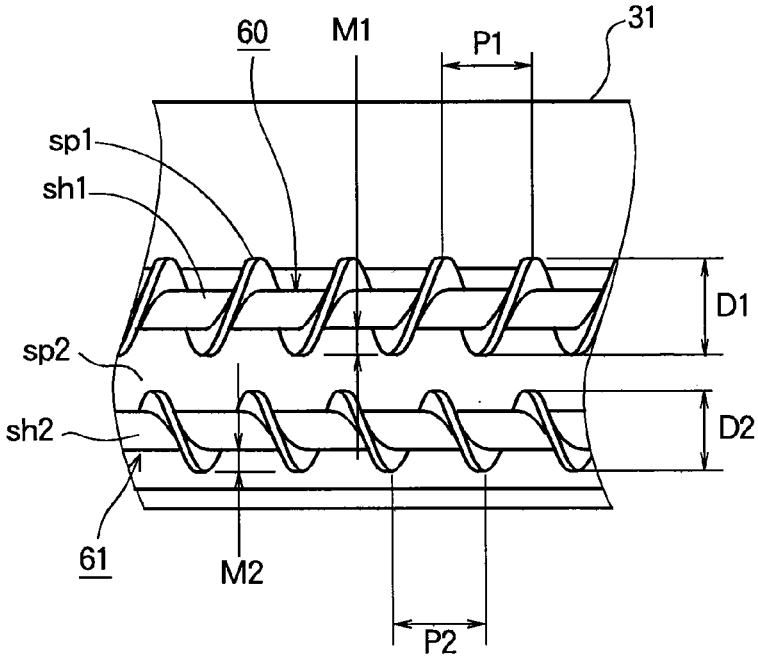
FIG. 5 is an enlarged view of the main part of the developing device according to the first embodiment of the present invention.
Figure 6:
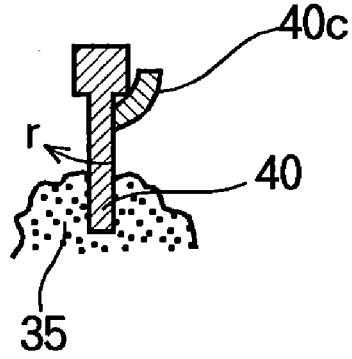
FIG. 6 is a schematic view showing an operation of an agitating blade in a state where a small amount of toner is stored in a developer storing chamber according to the first embodiment of the present invention.
Figure 7:
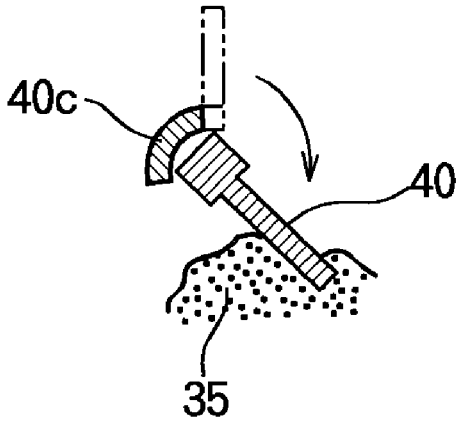
FIG. 7 is a schematic view showing an operation of the agitating blade in a state where a large amount of toner is stored in the developer storing chamber according to the first embodiment of the present invention.

FIG. 2 is a sectional view of the developing device according to the first embodiment of the present invention. FIG. 3 is a perspective view of the developing device according to the first embodiment of the present invention. FIG. 4 is a plan view of the main part of the developing device according to the first embodiment of the present invention. FIG. 5 is an enlarged view of the main part of the developing device according to the first embodiment of the present invention. FIG. 6 is a schematic view showing an operation of an agitating blade in a state where a small amount of toner is stored in a developer storing chamber according to the first embodiment of the present invention. FIG. 7 is a schematic view showing an operation of the agitating blade in a state where a large amount of toner is stored in the developer storing chamber according to the first embodiment of the present invention.

As shown in FIG. 2, the toner 35 is stored in a toner cartridge 27 as a developer storing chamber. The toner cartridge 27 is detachably attached to the main body of the developing device 16BK. A toner shielding wall 36 is rotatably disposed at the bottom of the toner cartridge 27. Before the toner cartridge 27 is attached to the developing device 16, the toner shielding wall 36 closes a toner supply port 37 of the toner cartridge 27, so as to seal in the toner 35.

A developer storing chamber 38 is formed on the lower part of the developing device 16BK beneath the toner cartridge 27. The developer storing chamber 38 has a supply port 22 (i.e., a developer supply port) located above the center portion of the photosensitive drum 52BK in the axial direction thereof. The developer storing chamber 38 stores the toner 35 supplied by the toner cartridge 27. A toner replenishing member 39 is rotatably disposed in the supply port 22. The toner replenishing member 39 has a recess (i.e., a toner receiver) that receives the toner.

The photosensitive drum 52BK is disposed in adjacent to the developer storing chamber 38 so that the photosensitive drum 52BK is able to rotate in the direction shown by an arrow "c". A developing roller (i.e., a developer bearing body) 31 partially faces the inside of the developer storing chamber 38. The developing roller 31 contacts the photosensitive drum 52BK and the developing roller 31 is able to rotate in the direction shown by an arrow "d". A supplying roller 42 (i.e., a developer supplying member) is disposed in the developer storing chamber 38 so that the supplying roller 42 contacts the developing roller 31 and the supplying roller 42 is able to rotate in the direction shown by an arrow "e". A first developer carrying member 60 is disposed above the developing roller 31 and the supplying roller 42, and is disposed on a position almost equidistant from the developing roller 31 and the supplying roller 42. The first developer carrying member 60 is disposed parallel to the developing roller 31, and the first developer carrying member 60 is able to rotate in the direction shown by an arrow "f". A second developer carrying member 61 is disposed at the rear side (i.e., the right side in FIG. 2) of the first developer carrying member 60. The second developer carrying member 61 is disposed parallel to the first developer carrying member 60, and the second developer carrying member 61 is able to rotate in the direction shown by an arrow "g". The distance between the first developer carrying member 60 and the developing roller 31 is less than the distance between the second developer carrying member 61 and the developing roller 31.

An agitating blade (i.e., a leveling member) 40 is disposed above the first and second developer carrying members 60 and 61, and is disposed on a position almost equidistant from the first and second developer carrying members 60 and 61. The agitating blade 40 is able to rotate in the direction shown by an arrow "j". By the rotation of the agitating blade 40, the agitating blade 40 agitates and levels the toner 35 in the developer storing chamber 38. As shown in FIG. 3, both ends of the axis of the agitating blade 40 protrude to the exterior of the developer storing chamber 38. A reflecting mirror 40*a* (i.e., an element to be detected) is formed on one end of the axis of the agitating blade 40. The reflecting mirror 40*a* faces a reflection sensor 41 (i.e., a residual amount detector) disposed in the main body of the printer. The reflection sensor 41 detects the residual amount of the toner 35 in the developer storing chamber 38, based on a movement of the agitating blade 40 that falls from a top dead point by its own weight.

In FIG. 2, the LED head 21Bk exposes the surface of the photosensitive drum 52BK to form a latent image. A developing blade 43 contacts the developing roller 31 so as to form a thin layer of the toner 35 on the developing roller 31. A charging roller (i.e., a charger) 44 uniformly charges the surface of the photosensitive drum 52BK. A cleaning blade (i.e., a cleaning device) 45 is so disposed that an end portion of the cleaning blade 45 contacts the photosensitive drum 52BK. The cleaning blade 45 scrapes the residual toner 35 out of the surface of the photosensitive drum 52Bk and removes the residual toner 35 therefrom. A waste toner carrying spiral 46 carries the residual toner scraped by the cleaning blade 45.

In FIGS. 3 and 4, a gear 31*a* is provided for rotating the developing roller 31. A gear 42*a* is provided for rotating the supplying roller 42. A gear 60*a* is provided for rotating the first developer carrying member 60. A gear 61*a* is provided for rotating the second developer carrying member 61. An idle gear 47 engages the gears 42*a*, 60*a* and 61*a*. A gear 40*b* is provided for rotating the agitating blade 40. The gear 40*b* has a projection 40*c* formed at an end thereof. The projection 40*c* of the gear 40*b* projects in the interior of the developer storing chamber 38, engages the end of the agitating blade 40, and pushes the agitating blade 40 to rotate.

The agitating blade 40 pushed by the projection 40*c* rotates in the direction shown by an arrow "r" in FIG. 6, and agitates the toner 35. After the agitating blade 40 passes the top dead point (shown by two dashed line in FIG. 7), the agitating blade 40 falls on the toner 35 by its own weight as shown in FIG. 7.

Next, the relationship between the first and second developer carrying members 60 and 61 will be described.

As shown in FIG. 5, the first developer carrying member 60 includes a shaft sh1, and a spiral portion (i.e., a first spiral portion) sp1 formed around the shaft sh1 at a constant pitch P1. The second developer carrying member 61 includes a shaft sh2, and a spiral portion (i.e., a second spiral portion) sp2 formed around the shaft sh2 at a constant pitch P2 and having spiral angles opposite to those of the spiral portion sp1. The spiral portion sp1 has symmetric two parts (i.e., left and right parts in FIG. 4) whose spiral angles are opposite to each other with respect to a center of the shaft sh1. The spiral portion sp2 has symmetric two parts whose spiral angles are opposite to each other with respect to a center of the shaft sh2. The outer diameter of the first developer carrying member 60 is expressed as D1, and the outer diameter of the second developer carrying member 61 is expressed as D2. The depth of the groove of the first developer carrying member 60 formed by the spiral portion sp1 is expressed as M1, and the depth of the groove of the second developer carrying member 61 formed by the spiral portion sp2 is expressed as M2.

The first and second developer carrying members 60 and 61 are so formed as to satisfy the following first to third conditions:

the first condition: D1>D2, the second condition: M1>M2, and the third condition: P1=P2.

These first to third conditions are satisfied throughout the whole lengths of the first and second developer carrying members 60 and 61.

Next, the operation of the above constructed printer will be described.

When a command to print an image is inputted by a not shown external device, a not shown controller controls the separation roller 12 (FIG. 2) to pick up one recording sheet from the stack on the sheet cassette 11, and controls the feeding rollers 13*a* and 13*b* and the carrying roller portions 14 and 15 to feed the recording sheet to the carrying belt 17.

In the developing devices 16BK, 16Y, 16M and 16C, the charging rollers 44 charge the surfaces of the photosensitive drums 52BK, 52Y, 52M and 52C uniformly and evenly, and the LED heads 21BK, 21Y, 21M and 21C form latent images by exposing the surfaces of the photosensitive drums 52BK, 52Y, 52M and 52C so that electric potentials of the exposed parts are reduced to close to 0(V).

Then, with the rotation of the photosensitive drums 52BK, 52Y, 52M and 52C in the direction shown by the arrow "c", the latent images on the photosensitive drums 52BK, 52Y, 52M and 52C move and contact the developing rollers 31. In this state, the toner 35 on the developing rollers 31 adhere to the photosensitive drums 52BK, 52Y, 52M and 52C to develop the latent image, so that the toner image of the respect colors are formed.

For this purpose, the supplying rollers 42 rotate according to the rotation of the gears 42*a* in the direction shown by the arrow "e" driven by not shown driving sources, and supply the toner 35 to the developing rollers 31. Further, the developing rollers 31 rotate according to the rotation of the gears 31*a* in the direction shown by the arrow "d" driven by not shown driving sources, and supply the toner 35 to the photosensitive drums 52BK, 52Y, 52M and 52C. The toner 35 on the developing rollers 31 are formed into thin layers by means of the developing blades 43, and are charged by frictional electrification.

Then, the recording sheets are carried by the carrying belt 17 through between the respective photosensitive drums 52BK, 52Y, 52M and 52C and the transfer rollers 51BK, 51Y, 51M and 51C, and the toner images on the photosensitive drums 52Bk, 52Y, 52M and 52C are transferred to the recording sheet in series. As a result, a color image is formed on the recording sheet.

Then, the recording sheet is carried to the fixing unit 18, and the toner image is fixed to the recording sheet, with the result that the color image is fixed to the recording sheet. Then, the recording sheet is carried by the carrying rollers 19, ejected to the exterior of the printer by the eject rollers 20, and stacked on the upper cover 23.

After the toner images on the photosensitive drums 52BK, 52Y, 52M and 52C are transferred to the recording sheet, the cleaning blades 45 scrape the residual toner from the surfaces of the photosensitive drums 52BK, 52Y, 52M and 52C. Then, the waste toner carrying spirals 46 eject the waste toner in the developing devices 16BK, 16Y, 16M and 16C to the exterior thereof.

Each first developer carrying member 60 rotates in the direction shown by the arrow "f" (FIG. 3) by the rotation transmitted from the idle gear 47 to the gear 60*a*, and carries the toner 35 at the end portions 38*c* and 38*d* of the developer storing chamber 38 to the center portion 38*b* of the developer storing chamber 38, i.e., in the directions shown by arrows "k" and "l" in FIG. 4. Further, each second developer carrying member 61 rotates in the direction shown by the arrow "g" (FIG. 3) by the rotation transmitted from the idle gear 47 to the gear 61*a*, and carries the toner 35 at the center portion 38*b* of the developer storing chamber 38 (or the toner 35 supplied from the supply port 22) to the end portions 38*c* and 38*d* of the developer storing chamber 38, i.e., in the directions shown by arrows "m" and "n" in FIG. 4. As a result, a flow of the toner 35 circulating in the developer storing chamber 38 is generated, which flows from the center portion 38*b* to the end portions 38*c* and 38*d* and flows from the end portions 38*c* and 38*d* to the center portion 38*b*. The number of rotations R1 of the first developer carrying member 60 per unit time and the number of rotations R2 of the second developer carrying member 61 per unit time satisfy the following fourth condition:

the fourth condition: R1=R2.

If the toner 35 above the first and second developer carrying members 60 and 61 forms a crest as shown in FIG. 3, the above described agitating blade 40 disturbs the crest and carries the toner 35 toward the end portions (i.e., in the directions shown by arrows "h" and "i") so that the toner 35 is leveled.

If the amount of the toner 35 in the developer storing chamber 38 is less than the predetermined amount, the agitating blade 40 is not pressured by the toner 35. Therefore, as shown in FIG. 7, the agitating blade 40 falls by its own weight and reaches a bottom dead point faster than the projection 40*c*. In this case, when the reflection sensor 41 detects the falling of the agitating blade 40 via the reflection plate 40*a*, the controller drives a not shown driving source to rotate the toner replenishing member 39 (FIG. 2) to supply the toner 35 to the developer storing chamber 38.

Then, the projection 40*c* rotates to push the agitating blade 40 to rotate upward as shown in FIG. 6. When the agitating blade 40 passes the top dead point (shown by two dashed line in FIG. 7), the agitating blade 40 falls on the toner 35 by its own weight.

As shown in FIG. 2, if the amount of the toner 35 in the developer storing chamber 38 exceeds the predetermined amount, the agitating blade 40 under the pressure of the toner 35 is pushed by the projection 40*c* and rotates in synchronization with the gear 40*b*. In this case, the agitating blade 40 constantly stays in the toner 35. Therefore, the agitating blade 40 does not falls by its own weight even after the agitating blade 40 passes the top dead point, but rotates in synchronization with the gear 40*b*. In a state where the reflection sensor 41 does not detect the falling of the agitating blade 40, the control unit stops rotating the toner replenishing member 39 to stop supplying the toner 35 to the developer storing chamber 38.

As described above, according to the first embodiment, the first and second developer carrying members 60 and 61 cause a circulating flow of the toner 35 that flows from the center portion 38*b* toward the end portions 38*c* and 38*d* of the developer storing chamber 38 and flows from the end portions 38*c* and 38*d* toward the center portion 38*b* of the developer storing chamber 38.

Further, as described above, the developer carrying members 60 and 61 are so formed as to satisfy the above described first through third conditions, and the developer carrying members 60 and 61 are so rotated as to satisfy the above described fourth condition. Therefore, the amounts S1 and S2 of the toner 35 carried by the first and second developer carrying members 60 and 61 per unit time satisfy the following relationship:

S1>S2.

Since the amount of the toner 35 at the center portion 38*b* increases, and since the amount of the toner 35 at the end portions 38*c* and 38*d* decreases, it becomes possible to prevent the agglomeration of the toner 35 at the end portions 38*c* and 38*d*. Therefore, it becomes possible to prevent the stain, fog or the like at the end portion of the recording sheet. Moreover, since the density of the toner 35 at the center portion 38*b* does not decrease, it becomes possible to prevent the image blurring at the center portion of the recording sheet. Furthermore, a difference between charges of the toner 35 (adhering to the developing roller 31) at the end portions 38*c* and 38*d* and at the center portion 38*b* can be restricted, and therefore the unevenness of the image density can be prevented.

Accordingly, the quality of the image can be enhanced.

Additionally, if the toner 35 is concentrated at the center portion 38*b* of the developer storing chamber 38 and forms a crest which is convex at the center, the agitating blade 40 carries the toner 35 toward the end portions 38*c* and 38*d*, and therefore the distribution of the toner 35 at the center portion 38*b* and at the end portions 38*c* and 38*d* can be evened. As a result, the unevenness of the image density can be further prevented, and the quality of the image can be further enhanced.

Further, even when the fluidity of the toner 35 in the developer storing chamber 38 decreases, the agglomeration of the toner 35 at the end portions 38*c* and 38*d* of the developer storing chamber 38 can be prevented.

Moreover, the following condition between the amounts S1 and S2 of the toner 35 carried by the first and second developer carrying members 60 and 61 per unit time can be obtained:

S1>S2 without requiring the number of rotations R1 and R2 of the first and second developer carrying members 60 and 61 per unit time to satisfy the following condition:

R1>R2.

Therefore, it is not necessary to rotate any of the first and second developer carrying members 60 and 61 at a high speed. Accordingly, the damage on the toner 35 can be prevented, and the quality of the image can be enhanced. Further, the toner 35 does not intrude into portions of the respective rotation shafts, and therefore the toner leakage can be prevented.

Second Embodiment

Next, the second embodiment of the present invention will be described. Components having the same structures as those of the first embodiment are assigned the same reference numerals, and the duplicate explanation is omitted. With regard to the advantages obtained by the same structures as those of the first embodiment, the description of the advantages in the first embodiment is incorporated herewith.

Figure 8:
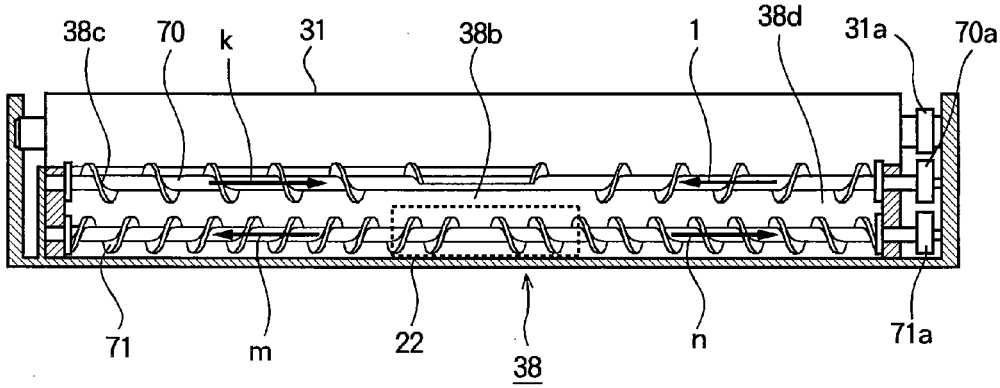
FIG. 8 is a plan view of a main part of a developing device according to a second embodiment of the present invention.
Figure 9:
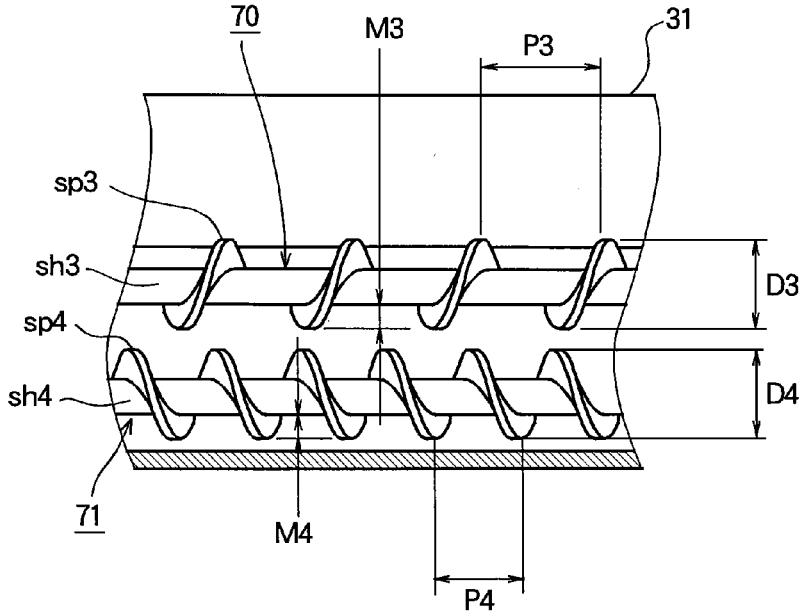
FIG. 9 is an enlarged view of the main part of the developing device according to the second embodiment of the present invention.

FIG. 8 is a plan view of a main part of a developing device according to the second embodiment of the present invention. FIG. 9 is an enlarged view of the main part of the developing device according to the second embodiment of the present invention.

In FIGS. 8 and 9, a first developer carrying member 70 has a shaft portion sh3 and a spiral portion sp3 formed around the shaft portion sh3 at a constant pitch P3. A second developer carrying member 71 has a shaft portion sh4 and a spiral portion sp4 formed around the shaft portion sh4 at a constant pitch P4 and having spiral angles opposite to those of the spiral portion sp3. The spiral portion sp3 has symmetric two parts (i.e., left and right parts in FIG. 8) whose spiral angles are opposite to each other with respect to a center of the shaft sh3. The spiral portion sp4 has symmetric two parts whose spiral angles are opposite to each other with respect to a center of the shaft sh4.

The outer diameter of the first developer carrying member 70 is expressed as D3, and the outer diameter of the second developer carrying member 71 is expressed as D4. The depth of the groove of the first developer carrying member 70 formed by the spiral portion sp3 is expressed as M3, and the depth of the groove of the second developer carrying member 71 formed by the spiral portion sp4 is expressed as M4.

The first and second developer carrying members 70 and 71 are so formed as to satisfy the following first to third conditions:

the first condition: D3=D4, the second condition: M3=M4, and the third condition: P3>P4.

These first to third conditions are satisfied throughout the whole lengths of the first and second developer carrying members 70 and 71.

The first developer carrying member 70 rotates in the direction shown by the arrow "f" (FIG. 3) by the rotation transmitted from the idle gear 47 (FIG. 3) to a gear 70*a*, and carries the toner 35 at the end portions 38*c* and 38*d* of the developer storing chamber 38 to the center portion 38*b* of the developer storing chamber 38, i.e., in the directions shown by arrows "k" and "l" in FIG. 8. Further, the second developer carrying member 71 rotates in the direction shown by the arrow "g" (FIG. 3) by the rotation transmitted from the idle gear 47 (FIG. 3) to a gear 71*a*, and carries the toner 35 supplied from the supply port 22 at the center portion 38*b* of the developer storing chamber 38 to the end portions 38*c* and 38*d* of the developer storing chamber 38, i.e., in the directions shown by arrows "m" and "n" in FIG. 8. As a result, a flow of the toner 35 circulating in the developer storing chamber 38 is generated, which flows from the center portion 38*b* toward the end portions 38*c* and 38*d* and flows from the end portions 38*c* and 38*d* toward the center portion 38*b*. The number of rotations R3 of the first developer carrying member 70 per unit time and the number of rotations R4 of the second developer carrying member 71 per unit time satisfy the following fourth condition:

the fourth condition: R3=R4.

As described above, according to the second embodiment, the first and second developer carrying members 70 and 71 cause a circulating flow of the toner 35 that flows from the center portion 38*b* toward the end portions 38*c* and 38*d* of the developer storing chamber 38 and flows from the end portions 38*c* and 38*d* toward the center portion 38*b* of the developer storing chamber 38.

Further, as described above, the developer carrying members 70 and 71 are so formed as to satisfy the above described first through third conditions, and the developer carrying members 70 and 71 are so rotated as to satisfy the above described fourth condition. Therefore, the amounts S3 and S4 of the toner 35 carried by the first and second developer carrying members 70 and 71 per unit time satisfy the following relationship:

S3>S4.

Since the amount of the toner 35 at the center portion 38*b* increases, and since the amount of the toner 35 at the end portions 38*c* and 38*d* decreases, it becomes possible to prevent the agglomeration of the toner 35 at the end portions 38*c* and 38*d*. Therefore, it becomes possible to prevent the stain, fog or the like at the end portion of the recording sheet. Moreover, since the density of the toner 35 at the center portion 38*b* does not decrease, it becomes possible to prevent the image blurring at the center portion of the recording sheet. Furthermore, a difference between charges of the toner 35 (adhering to the developing roller 31) at the end portions 38*c* and 38*d* and at the center portion 38*b* can be restricted, and therefore the unevenness of the image density can be prevented.

Accordingly, the quality of the image can be enhanced.

Third Embodiment

The third embodiment of the present invention will be described. Components having the same structures as those of the first and second embodiments are assigned the same reference numerals, and the duplicate explanation is omitted. With regard to the advantages obtained by the same structures as those of the first and second embodiments, the description of the advantages in the first and second embodiments is incorporated herewith.

Figure 10:
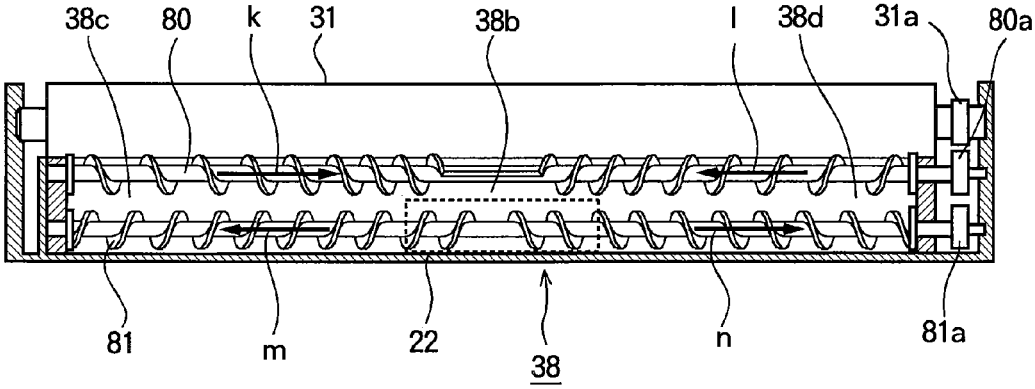
FIG. 10 is a plan view of a main part of a developing device according to a third embodiment of the present invention.
Figure 11:
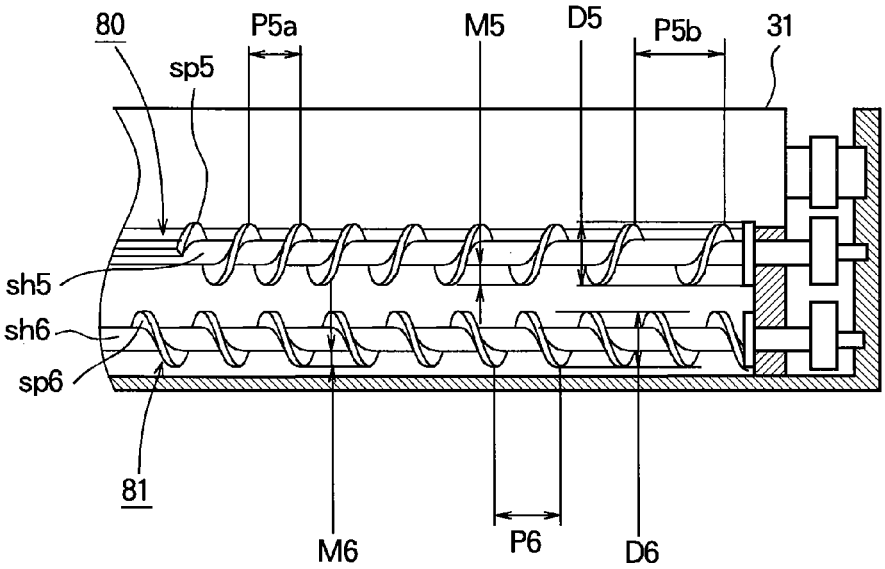
FIG. 11 is an enlarged view of the main part of the developing device according to the third embodiment of the present invention.
Figure 12:
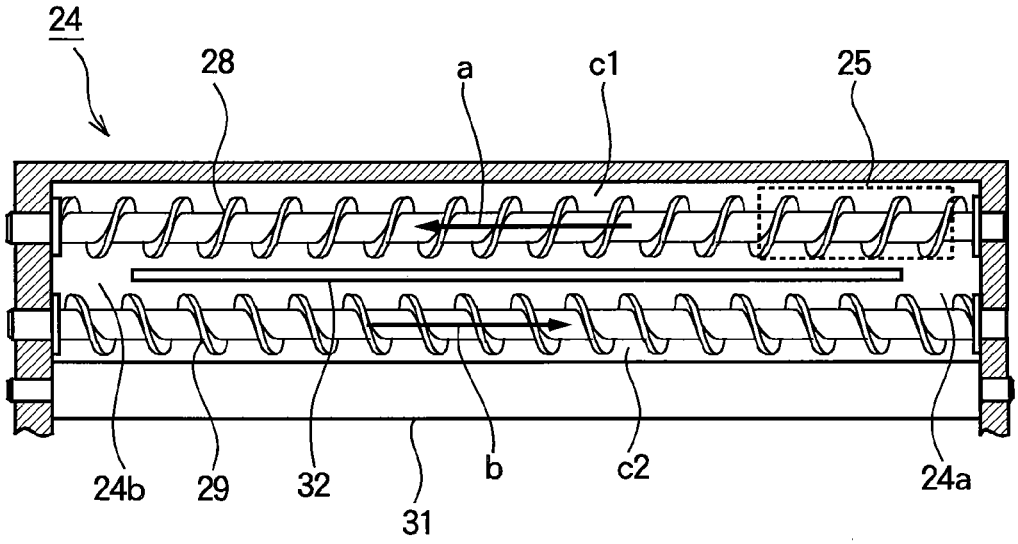
FIG.12 CONVENTIONAL ART
FIG. 12 is a plan view of a main part of a conventional developing device.

FIG. 10 is a plan view of a main part of a developing device according to the third embodiment of the present invention. FIG. 11 is an enlarged view of the main part of the developing device according to the third embodiment of the present invention.

In FIGS. 10 and 11, a first developer carrying member 80 has a shaft portion sh5 and a spiral portion sp5 formed around the shaft portion sh5 at a varied pitches P5*a* and P5*b*. A second developer carrying member 81 has a shaft portion sh6 and a spiral portion sp6 formed around the shaft portion sh6 at a constant pitch P6 and having spiral angles opposite to those of the spiral portion sp5. The spiral portion sp5 has symmetric two parts (i.e., left and right parts in FIG. 10) whose spiral angles are opposite to each other with respect to a center of the shaft sh5. The spiral portion sp6 has symmetric two parts whose spiral angles are opposite to each other with respect to a center of the shaft sh6.

The outer diameter of the first developer carrying member 80 is expressed as D5, and the outer diameter of the second developer carrying member 81 is expressed as D6. The depth of the groove of the first developer carrying member 80 formed by the spiral portion sp5 is expressed as M5, and the depth of the groove of the second developer carrying member 81 formed by the spiral portion sp6 is expressed as M6.

The first and second developer carrying members 80 and 81 are so formed as to satisfy the following first to third conditions:

the first condition: D5>D6, the second condition: M5>M6, and the third condition: P5*b*>P6≧P5*a*.

In the first developer carrying member 80, the outer diameter D5 and the depth M5 of the groove are constant throughout the whole length of the first developer carrying member 80, and only the pitch varies (between pitches P5*a* and P5*b*)

along the axis of the first developer carrying member 80. In the second developer carrying member 81, the outer diameter D6, the depth M6 of the groove and the pitch P6 are respectively constant throughout the whole length of the second developer carrying member 81.

The first developer carrying member 80 rotates in the direction shown by the arrow "f" (FIG. 3) by the rotation transmitted from the idle gear 47 (FIG. 3) to a gear 80*a*, and carries the toner 35 at the end portions 38*c* and 38*d* of the developer storing chamber 38 to the center portion 38*b* of the developer storing chamber 38, i.e., in the directions shown by arrows "k" and "l" in FIG. 10. Further, the second developer carrying member 81 rotates in the direction shown by the arrow "g" (FIG. 3) by the rotation transmitted from the idle gear 47 (FIG. 3) to a gear 81*a*, and carries the toner 35 supplied from the supply port 22 at the center portion 38*b* of the developer storing chamber 38 to the end portions 38*c* and 38*d* of the developer storing chamber 38, i.e., in the directions shown by arrows "m" and "n" in FIG. 10. As a result, a flow of the toner 35 circulating in the developer storing chamber 38 is generated, which flows from the center portion 38*b* toward the end portions 38*c* and 38*d* and flows from the end portions 38*c* and 38*d* toward the center portion 38*b*. The number of rotations R5 of the first developer carrying member 80 per unit time and the number of rotations R6 of the second developer carrying member 81 per unit time satisfy the following fourth condition:

the fourth condition: R5=R6.

As described above, according to the third embodiment, the first and second developer carrying members 80 and 81 cause a circulating flow of the toner 35 that flows from the center portion 38*b* toward the end portions 38*c* and 38*d* of the developer storing chamber 38 and flows from the end portions 38*c* and 38*d* toward the center portion 38*b* of the developer storing chamber 38.

Further, as described above, the developer carrying members 80 and 81 are so formed as to satisfy the above described first through third conditions, and the developer carrying members 80 and 81 are so rotated as to satisfy the above described fourth condition. Therefore, the amount S5*a* of the toner 35 carried by the center portion of the first developer carrying member 80 per unit time, the amount S5*b* of the toner 35 carried by the end portions of the first developer carrying member 80 per unit time, and the amount S6 of the toner 35 carried by the second developer carrying member 81 per unit time satisfy the following relationship:

$S5b > S6 \geqq S5a$.

Since the amount of the toner 35 at the center portion 38*b* increases, and since the amount of the toner 35 at the end portions 38*c* and 38*d* decreases, it becomes possible to prevent the agglomeration of the toner 35 at the end portions 38*c* and 38*d*. Therefore, it becomes possible to prevent the stain, fog or the like at the end portion of the recording sheet. Moreover, since the density of the toner 35 at the center portion 38*b* does not decrease, it becomes possible to prevent the image blurring at the center portion of the recording sheet. Furthermore, a difference between charges of the toner 35 (adhering to the developing roller 31) at the end portions 38*c* and 38*d* and at the center portion 38*b* can be restricted, and therefore the unevenness of the image density can be prevented.

Accordingly, the quality of the image can be enhanced.

Moreover, since the pitch P5*b* at the end portions of the first developer carrying member 80 is large, the agglomeration of the toner 35 in the groove of the spiral portion sp5 at each end portion hardly occurs (compared with the toner 35 at the groove at the center portion). Therefore, the deterioration of the carrying ability of the toner 35 can be prevented.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a developer bearing body that partially faces an inside of a developer storing chamber, said developer bearing body being rotatable and bearing a developer;

a first developer carrying member disposed in said developer storing chamber together with said developer bearing body, said first developer carrying member rotating to carry said developer in an axial direction, and a second developer carrying member disposed in said developer storing chamber together with said first developer carrying member, said second developer carrying member rotating to carry said developer in an axial direction, wherein said first developer carrying member carries said developer from end portions of said developer storing chamber toward a center portion of said developer storing chamber, and said second developer carrying member carries said developer from said center portion toward said end portions, and wherein an amount of said developer carried from said end portions toward said center portion of said developer storing chamber is greater than an amount of said developer carried from said center portion toward said end portions of said developer storing chamber.

2. The developing device according to claim 1, wherein a distance between said first developer carrying member and said developer bearing body is less than a distance between said second developer carrying member and said developer bearing body.

3. The developing device according to claim 1, wherein said first and second developer carrying members respectively have spiral portions, and wherein an outer diameter of said spiral portion of said first developer carrying member is larger than an outer diameter of said spiral portion of said second developer carrying member.

4. The developing device according to claim 1, wherein said first and second developer carrying members respectively have spiral portions, and wherein a pitch of said spiral portion of said first developer carrying member is larger than a pitch of said spiral portion of said second developer carrying member.

5. The developing device according to claim 1, wherein said first and second developer carrying members respectively have spiral portions that form grooves, and wherein a depth of said groove of said first developer carrying member is deeper than a depth of said groove of said second developer carrying member.

6. The developing device according to claim 1, wherein said first developer carrying member has a spiral portion, and wherein a pitch of said spiral portion at each end portion of said first developer carrying member is larger than a pitch of said spiral portion at a center portion of said first developer carrying member.

7. The developing device according to claim 1, further comprising a developer supply port for supplying said developer to said developer storing chamber, wherein said developer supply port is disposed on a center portion of said developer storing chamber in an axial direction of said developer bearing body.

8. The developing device according to claim 1, further comprising a leveling member disposed above said first and second developer carrying members for leveling said developer stored in said developer storing chamber.

9. An image forming apparatus comprising:

said developing device according to claim 1.

10. The developing device according to claim 1, further comprising a developer supplying member disposed below said first and second developer carrying members, wherein said developer carried by said first and second developer carrying members is supplied to said developer bearing body via said developer supplying member.

* * * * *